United States Patent [19]

Scheidegger et al.

[11] 4,139,431

[45] Feb. 13, 1979

[54] PROCESS AND APPARATUS FOR THE REMOVAL OF SILVER FROM FIXER SOLUTIONS

[75] Inventors: Rudolf Scheidegger, Feldmeilen; August Zurrer, Marly, both of Switzerland

[73] Assignee: Ciba-Geigy AG, Basel, Switzerland

[21] Appl. No.: 879,991

[22] Filed: Feb. 22, 1978

[30] Foreign Application Priority Data

Feb. 28, 1977 [CH] Switzerland ..... 2459/77

[51] Int. Cl.[2] ..... C25C 1/20

[52] U.S. Cl. ..... 204/109; 204/149; 204/228; 204/237

[58] Field of Search ..... 204/109, 149, 46 R, 204/228, 234, 237

[56] References Cited

U.S. PATENT DOCUMENTS

| | | | |
|---|---|---|---|
| 2,110,930 | 3/1938 | Doffin | 204/109 X |
| 2,196,764 | 4/1940 | Folwell | 204/109 X |
| 3,463,711 | 8/1969 | Geyken | 204/109 |
| 3,616,435 | 10/1971 | Favell et al. | 204/228 |
| 3,767,558 | 10/1973 | Rowe | 204/109 X |
| 3,875,032 | 4/1975 | Thompson | 204/109 |
| 3,959,110 | 5/1976 | Burgess | 204/109 X |
| 4,018,658 | 4/1977 | Alfin et al. | 204/109 |

*Primary Examiner*—Arthur C. Prescott
*Attorney, Agent, or Firm*—Harry Falber

[57] ABSTRACT

An electrolytic process is used to reduce the silver content of fixer solution to a level such that it can be discharged as effluent. In the process silver is removed from aqueous fixer solutions by circulating the solution in a closed cycle through an electrolytic cell such that the residence time in the cell is not greater than one minute for each passage. The electrode loading is within the range between 5 and 15 mA/cm$^2$ initially but is reduced in at least one further chronologically consecutive stage. Exhausted developer solution may be added to the fixer solution to act as a pH controlling redox system.

7 Claims, 1 Drawing Figure

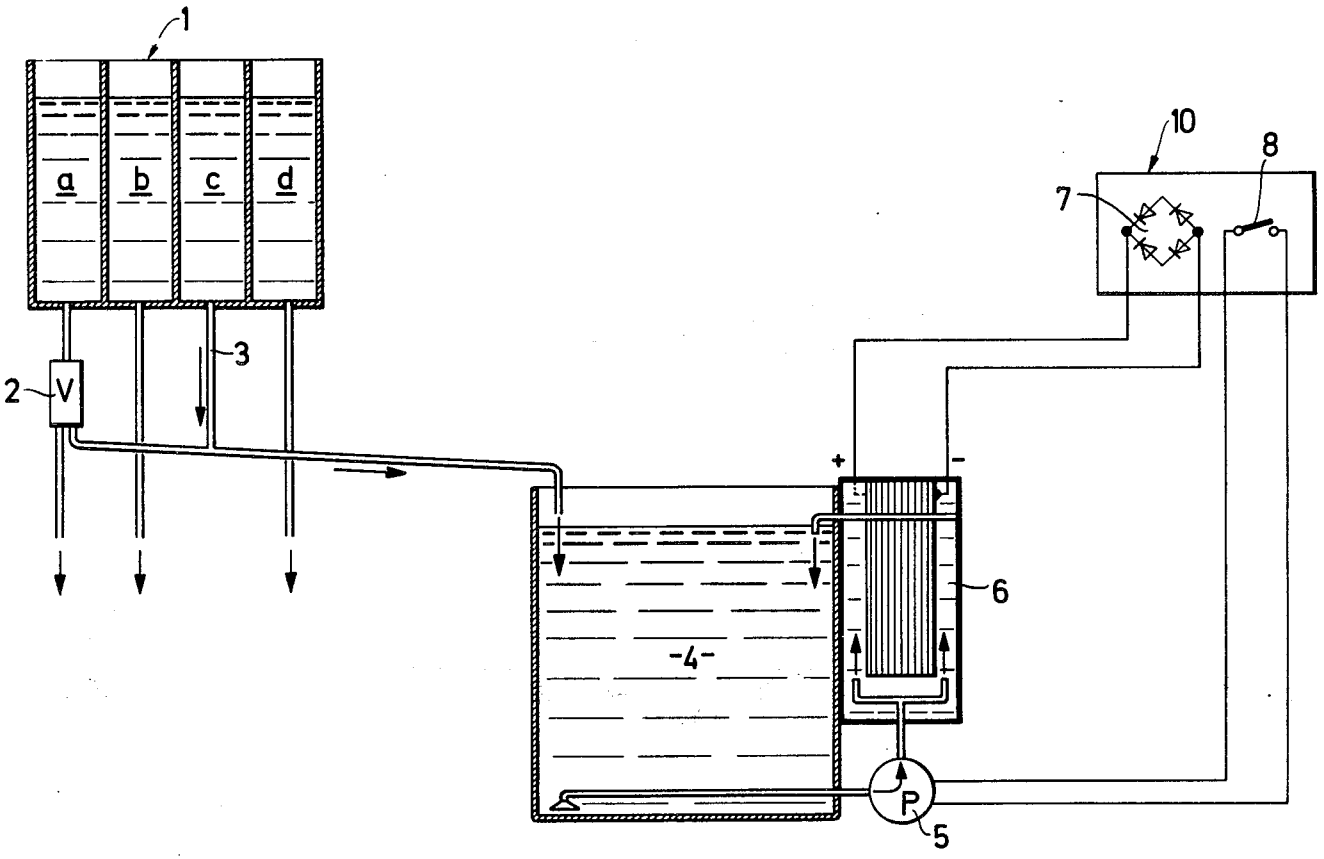
8
10
7
6
5
P
-
+
-4-
1
a
b
c
d
3
V
2

PROCESS AND APPARATUS FOR THE REMOVAL OF SILVER FROM FIXER SOLUTIONS

FIELD OF THE INVENTION

This invention relates to an electrolytic process for the removal of silver from fixer solutions, and to apparatus for carrying out such a process.

PRIOR ART

Aqueous solutions having a relatively high content (e.g. 100 to 400 g/liter) of readily soluble sodium, potassium or ammonium thiosulphates, are generally used for fixing silver halide based photographic images. The fixing solution may contain other additives in the form of thiocyanic acid salts, sodium sulphate, and also pH-controlling materials and, if required, fixing accelerators such as N-methylpyrrolidone. The concentration of soluble silver complexes gradually increases in the fixer solutions which, consequently, becomes exhausted.

Exhausted silver-containing fixer solutions must be regenerated particularly for environmental reasons since toxic silver ions must not be present in effluent discharge and in view of the value of silver it is economically desirable to recover it.

One known method for removing silver is based on the exchange of metal ions. The silver is deposited by means of a more electro-positive metal. For this purpose the exhausted fixer solution is circulated, for example, through a bed of steel shavings, metallic silver being deposited and a corresponding quantity of iron ions passing into solution. The deposited silver can be recovered by further purification processes. After removal of the iron ions the prepared solution can be discharged with the effluent. This process is simple and does not require any expensive installations, but a significant disadvantage is that the silver is recovered only incompletely and a further operation is required for removal of the iron ions.

Other known methods are based on electrolysis. Silver is deposited at the cathode of an electrolysis cell, in which the exhausted fixer solutions are treated. Given suitable choice of electrolysis conditions, the silver is deposited in a pure and relatively compact form and can be directly re-used. The desilvered fixing solution can be re-used in some cases. The electrodes may be located either directly in the fixing tank, in a separate compartment thereof, or in a cell into which the treated solution is passed, for example in a continuous cycle.

The prior-art electrolytic processes have various disadvantages, however. For example, the desilvering process can be carried out only to a specific residual silver content. Further electrolysis further results in the solution gradually turning cloudy, from brown to black, as a result of silver sulphide precipitation; blackish silver sulphide containing sludge starts to be deposited at the cathode instead of the desired compact silver coating. A bath treated in this way is unusable for either further use or for discharge to the effluent.

In electrolytic processes, the deposition of silver suplphide can be at least partially prevented by using only very low current loadings towards the end of the electrolysis, e.g. 1 to 2 mA/cm$^2$ electrode area or even less. The disadvantage of this known step is that the operation is prolonged; the residual silver content stipulated by effluent regulations cannot usually be obtained within a reasonable time.

OBJECT OF THE INVENTION

An object of the invention is to reduce or eliminate the disadvantages of the known electrolytic processes. It is a further object to provide a process in which silver substantially free of silver sulphide is deposited, while on the other hand the concentration of silver in the residual solution obtained is such that it can be directly discharged as effluent, and without requiring an excessively long treatment time.

SUMMARY OF THE INVENTION

According to the invention, the solution to be treated is circulated in a closed cycle from a reserovir through an electrolytic cell, the volume of the cell and the rate of circulation being so selected and adjusted that the residence time in the electrolytic cell is not greater than 1 minute maximum; the electrode loading (mA/cm$^2$) is reduced over a period of time, and in a preferred embodiment a pH-controlling redox system is added to the solution to be treated.

According to a preferred form of the process, the volumetric flow rate and the nett volume of the electrolysis cell are such that the residence time of the solution in the cell is 30 seconds maximum, preferably in the range 5 to 20 seconds, per passage.

The electrode loading (current density) is preferably between about 5 and 15 mA/cm$^2$ in a first stage, and 2–50% of this value in a subsequent second stage. A substantially constant current density is preferably used in each stage. The current density is usually determined according to the residual silver content.

Exhausted developer solution is preferably used as a pH-controlling redox system added before or during the process to the liquid for desilvering. More particularly, 0.1 to 0.5 parts exhausted developer solution are added to 1 part of the fixer solution.

The invention also relates to apparatus for performing the new process. This apparatus comprises an electrolytic cell connected in circuit with a storage tank via a pump, the pump delivery rate in liters per minute at least being equal to the usable volume of the electrolysis cell in liters.

BRIEF DESCRIPTION OF THE DRAWINGS

A preferred embodiment of the invention will now be described in detail hereafter with reference to the accompanying drawing in which is a schematic flow diagram of an apparatus for the electrolytic treatment of fixer solution from a photographic processing apparatus.

DETAILED DESCRIPTION OF THE PREFERRED EMBODIMENT

The drawing shows a photographic processing machine comprising a developer tank a, a stop bath b, a fixing bath c and a water tank d. Exhausted fixer solution is fed through a pipe 3 to the storage tank 4; also a secondary flow valve 2 is used to discharge a predetermined proportion of the exhausted developer solution from the tank a to the storage tank 4. From tank 4, exhausted fixer solution, mixed with exhausted developer, is circulated by a pump 5 through an electrolytic cell 6 and back to the storage tank 4. Silver deposits from the fixer solution onto the cathodes of this cell. The cell 6 is fed by a rectifier 7 through a controller 10 not shown in detail. Pump 5 receives power from the mains (220 V AC) via a switch 8.

The delivery rate of the pump 5 in liters per minute is at least equal to the nett volume of the tank 4; the delivery rate is preferably 2 to 12 times the tank volume and is controllable.

The electrode loading is similarly controllable. Starting from a first stage of 5 to 15 mA/cm$^2$, it can be lowered in stages e.g. in a ratio of 1:2 to 1:50. Two stages are sufficient for most cases.

The addition of material to control the pH value, more particularly in the form of exhausted developer from tank a, is also controllable by means of the secondary flow or control valve 2.

Controller 10 may be a programmable controller for automatically controlling all or at least some of the variables to a preselectable program. Controllers of this kind and their application are known.

Two series of experiments were carried out in an apparatus according to the drawing, comprising one electrolysis cell having a volume of about 9 liters and three cathodes with a total cathode area of 2496 cm$^2$.

The circulating pump delivery rate was set at 40 liters per minute in both series of experiments, so that the average residence time in the cell was 13.5 seconds.

The effect that the addition of exhausted developer had on the degree of removal was tested in the first series of experiments. For this purpose, the exhausted fixer solutions were treated for 8 hours at a current density of 4.8 mA/cm$^2$ and then for 12 hours at a current density of 0.8 mA/cm$^2$. With a total volume of 60 liters, the results given in the following Table were obtained, depending upon the amount of exhausted developer added in each case.

| Fixing bath Liters | Developer (exhausted) Liters | pH | Silver content in ppm Start | |
|---|---|---|---|---|
| 60 | — | 4.3 | 4989 | 250 |
| 57 | 3 | 4.5 | 3737 | 143 |
| 54 | 6 | 4.7 | 3495 | 127 |
| 51 | 9 | 4.85 | 4591 | 33 |
| 48 | 12 | 5.15 | 3959 | 15 |
| 45 | 15 | 5.45 | 4070 | 6 |
| 42 | 18 | 5.75 | 1803 | 3 |

The Table shows the favourable effect of the addition of exhausted developer on the degree of desilvering.

The effect that different developer constituents had on the final silver content was tested in the second series of experiments. For this purpose, 60 liters of exhaust fixer solution were adjusted to pH 6.0 and treated at a current density of 8.0 mA/cm$^2$ for 6 hours, and at a current density of 1.2 mA/cm$^2$ for another 12 hours. Different constituents were added and their influence on the degree of silver removal attainable was examined in order to investigate the effect of the exhausted developer. The result of this test is given in the following Table:

| Additive | | Silver content in ppm Start | End |
|---|---|---|---|
| — | | 4595 | 316 |
| — | | 4418 | 235 |
| — | | 4519 | 409 |
| 20 g Hydroquinone, 5 g Phenidone | not oxidized | 4756 | 132 |
| 20 g Hydroquinone, 5 g Phenidone | oxidized with air | 3955 | 32 |
| 50 g ascorbic acid | oxidized | 4415 | 77 |
| 30 g Metol | oxidized | 4156 | 48 |
| 30 g Pyrocatechol | oxidized | 4227 | 43 |
| 30 g Glycin | oxidized | 3983 | 40 |
| 30 g Pyrogallol | oxidized | 3915 | 39 |

The Table indicates that the conventionally used developer substances have a more favourable effect in the oxidized state than in the non-oxidized state.

What is claimed is:

1. An electrolytic process for removing silver from photographic fixer solution wherein the solution is circulated in a closed cycle including a reservoir and an electrolytic cell, the residence time of the fixer solution in said cell being not greater than 1 minute, the electrode loading (mA/cm$^2$) being reduced in chronologically consecutive stages.

2. The process according to claim 1, wherein said residence time is not greater than 30 seconds.

3. The process according to claim 1, wherein said residence time is in the range from 5 to 20 seconds.

4. The process according to claim 1, wherein the electrode loading is carried out in two stages, the current density in the first stage being between 5 and 15 mA/cm$^2$, and in the second stage between 2 and 50% of the value in the first stage.

5. The process according to claim 1, wherein a pH-controlling redox system is added to the solution to be treated.

6. The process according to claim 5, wherein the pH controlling redox system is exhausted developer solution.

7. The process according to claim 6, wherein 0.1 to 0.5 parts of exhaust developer solution are added to 1 part of the solution to be treated.

* * * * *